US011029081B2

(12) United States Patent
Safari Kermanshahi

(10) Patent No.: US 11,029,081 B2
(45) Date of Patent: Jun. 8, 2021

(54) SUPER SMART SAFARI 360° REFRIGERATOR AND FREEZER (CENTRAL MOBILITY AND ROTATION, MANUAL AND AUTOMATIC) EQUIPPED WITH WATER RESERVOIR, BATTERY AND INTERNET CONNECTION

(71) Applicant: Kamal Safari Kermanshahi, Tehran (IR)

(72) Inventor: Kamal Safari Kermanshahi, Tehran (IR)

( * ) Notice: Subject to any disclaimer, the term of this patent is extended or adjusted under 35 U.S.C. 154(b) by 262 days.

(21) Appl. No.: 15/778,445

(22) PCT Filed: Nov. 6, 2016

(86) PCT No.: PCT/IB2016/056667
§ 371 (c)(1),
(2) Date: May 23, 2018

(87) PCT Pub. No.: WO2017/089918
PCT Pub. Date: Jun. 1, 2017

(65) Prior Publication Data

US 2018/0347894 A1 Dec. 6, 2018

(30) Foreign Application Priority Data

Nov. 23, 2015 (IR) ..... 13945014000300957

(51) Int. Cl.
*F25D 23/10* (2006.01)
*F25D 23/12* (2006.01)
(Continued)

(52) U.S. Cl.
CPC ..... *F25D 23/10* (2013.01); *F25D 13/04* (2013.01); *F25D 23/028* (2013.01); *F25D 23/04* (2013.01); *F25D 23/12* (2013.01); *F25D 23/126* (2013.01); *A47F 3/10* (2013.01); *F25D 2400/30* (2013.01); *F25D 2400/361* (2013.01); *F25D 2400/38* (2013.01)

(58) Field of Classification Search
CPC ..... F25D 23/10; F25D 23/04; F25D 23/003; F25D 23/006; F25D 23/028
See application file for complete search history.

(56) References Cited

FOREIGN PATENT DOCUMENTS

MX 2007002843 A 11/2008

OTHER PUBLICATIONS

International Search Report of PCT/IB2016/056667,dated Jan. 24, 2017.

*Primary Examiner* — Brian M King

(57) ABSTRACT

This invention is Central refrigerator and freezer up to 360° access and view, polygonal and circular, rotary and mobile both manually and electrically by remote control, equipped with water and battery storage reservoir in the upper part of central cylinder, with smart digital system connected to internal and external cameras with the capability to send and receive messages and images to and from owner and/or near stores and connected to the network for smart shopping, with remote control and satellite telephones and the possibility for consumer to access from all sides instead of limited access from one side. This invention is in the field of mechanical engineering with a new model of a unit comprising of cooling, cool-maintaining and freezing plus fast freezing systems for food materials plus cold and hot water for tea and coffee maker and ice maker and equipped to microwave for cooking food.

16 Claims, 12 Drawing Sheets

1) Main door of freezer
2) Main door of refrigerator
3) Water storage reservoir
4) Wireless radio
5) Refrigerator ventilator
6) Upper door hinge
7) Water cooler and ice maker
8) Water heater, tea and coffee maker
9) Central computer capable to connect to internet plus LCD monitor
10) Handle gap
11) Digital temperature monitor
12) Cake and pastry container door
13) Container door for fast freezing of vegetables, fruits, meat, etc.
14) Mobile and rotary platform
15) Auxiliary mobile and rotary wheels
16) Main driving wheel capable to rotate 360°
17) Place of storage batteries
18) Main trunk of refrigerator
19) Central duct of cooling facilities
20) Liquids bottles container door

(51) Int. Cl.

| | |
|---|---|
| ***F25D 13/04*** | (2006.01) |
| ***F25D 23/02*** | (2006.01) |
| ***F25D 23/04*** | (2006.01) |
| *A47F 3/10* | (2006.01) |

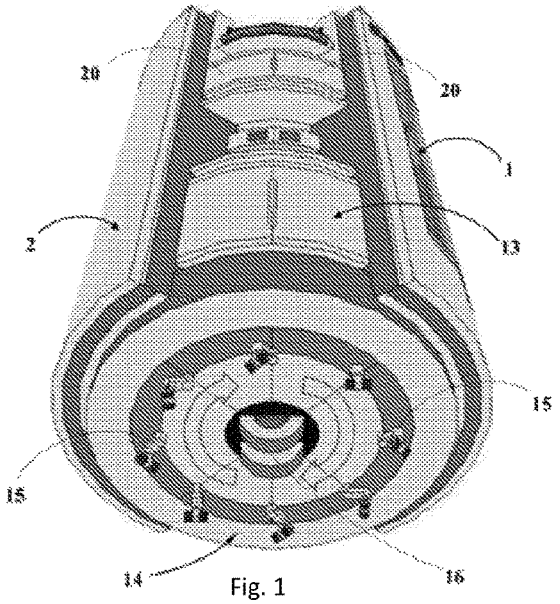

Fig. 1

1) Main door of freezer
2) Main door of refrigerator
3) Water storage reservoir
4) Wireless radio
5) Refrigerator ventilator
6) Upper door hinge
7) Water cooler and ice maker
8) Water heater, tea and coffee maker
9) Central computer capable to connect to internet plus LCD monitor
10) Handle gap
11) Digital temperature monitor
12) Cake and pastry container door
13) Container door for fast freezing of vegetables, fruits, meat, etc.
14) Mobile and rotary platform
15) Auxiliary mobile and rotary wheels
16) Main driving wheel capable to rotate 360°
17) Place of storage batteries
18) Main trunk of refrigerator
19) Central duct of cooling facilities
20) Liquids bottles container door

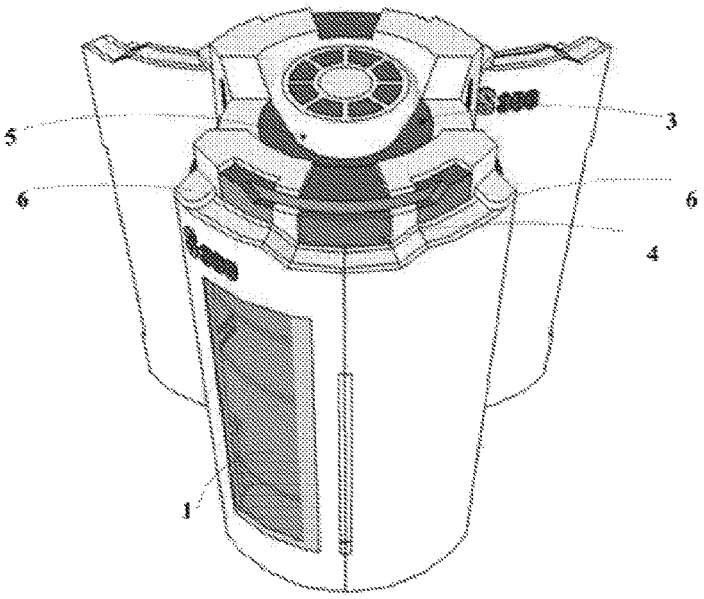

Fig. 2

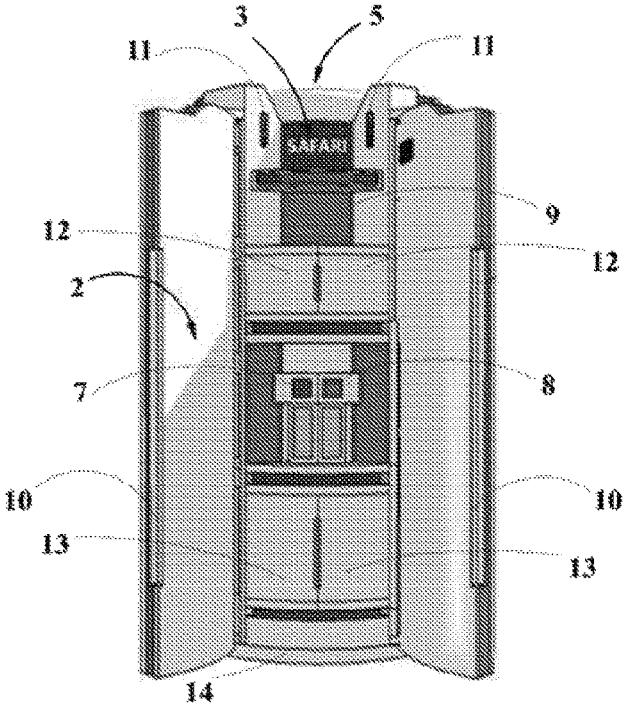

Fig. 3

1) Main door of freezer
2) Main door of refrigerator
3) Water storage reservoir
4) Wireless radio
5) Refrigerator ventilator
6) Upper door hinge
7) Water cooler and ice maker
8) Water heater, tea and coffee maker
9) Central computer capable to connect to internet plus LCD monitor
10) Handle gap
11) Digital temperature monitor
12) Cake and pastry container door
13) Container door for fast freezing of vegetables, fruits, meat, etc.
14) Mobile and rotary platform
15) Auxiliary mobile and rotary wheels
16) Main driving wheel capable to rotate 360°
17) Place of storage batteries
18) Main trunk of refrigerator
19) Central duct of cooling facilities
20) Liquids bottles container door

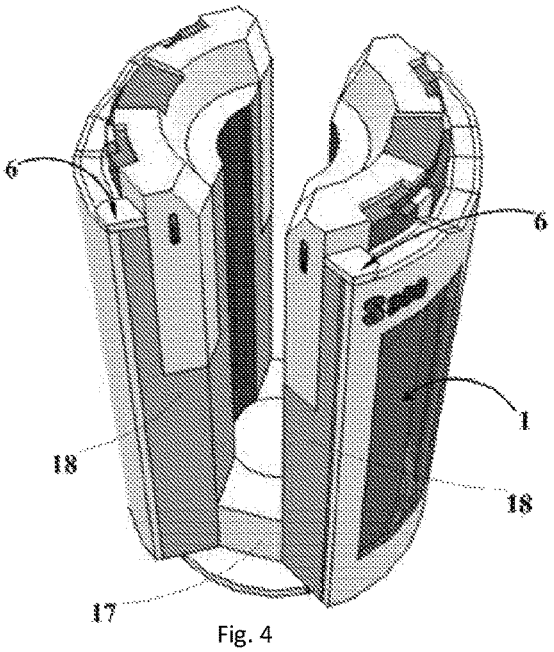

Fig. 4

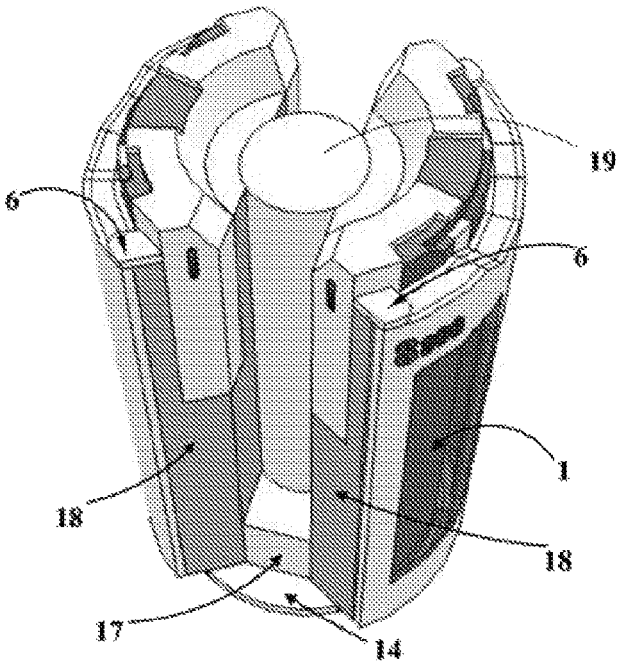

Fig. 5

1) Main door of freezer
2) Main door of refrigerator
3) Water storage reservoir
4) Wireless radio
5) Refrigerator ventilator
6) Upper door hinge
7) Water cooler and ice maker
8) Water heater, tea and coffee maker
9) Central computer capable to connect to internet plus LCD monitor
10) Handle gap
11) Digital temperature monitor
12) Cake and pastry container door
13) Container door for fast freezing of vegetables, fruits, meat, etc.
14) Mobile and rotary platform
15) Auxiliary mobile and rotary wheels
16) Main driving wheel capable to rotate 360°
17) Place of storage batteries
18) Main trunk of refrigerator
19) Central duct of cooling facilities
20) Liquids bottles container door Sample configuration of the refrigerator reconfigurable parts

SUPER SMART SAFARI 360° REFRIGERATOR AND FREEZER (CENTRAL MOBILITY AND ROTATION, MANUAL AND AUTOMATIC) EQUIPPED WITH WATER RESERVOIR, BATTERY AND INTERNET CONNECTION

REFERENCE TO RELATED APPLICATION

This application is a national application of PCT Application No. PCT/IB2016/056667 filed on Nov. 6, 2016, which claims priority of Iran patent application No. 139450140003009577 filed on Nov. 23, 2015, both of which disclosures are incorporated herein by reference in their entirety.

TECHNICAL BACKGROUND OF INVENTION

This invention is in the field of mechanical engineering with a new form and model of a unit comprising of cooling, cool-maintaining and freezing systems and fast freezing system for materials all such as food materials plus cold and hot water and ice maker.

TECHNICAL PROBLEM AND STATEMENT OF INVENTION GOALS

Technical Problem

Technical problem in previous models of refrigerators and freezers include the followings:

Restricted access from the sides to the stored materials. Previous models were always limited to walls and/or cabinets and they could be used only from one side.

In old models, restricted use and one-side access to food materials and a relatively high depth faced the consumers with problems accessing those food materials which had been placed in rows. In most cases, the front materials should be taken out to access to those materials which had been placed in the depth and this resulted in no serious use of the depth of refrigerators. This problem has been solved in the new model, in the manner that instead of using a high depth with access problems, consumers can simply open the doors to face a showcase with suitable and extensive depth of various food materials due to increase in external areas of refrigerator and they can easily access to all food and materials in the fridge.

Old single-door and side by side refrigerators adjusted the temperature only for one or two spaces and they prevented from different cooling adjustments for more spaces based on the related needs. By increasing the number of spaces and doors due to extensive areas of refrigerator, it is possible to separate and adjust cooling temperatures in several spaces according to cooling need both manually and smart and automatic in order to avoid energy wastage and to achieve more efficiency.

Statement of Invention Goals

Removing all the defects mentioned in the clause "technical problems" including the following items:

The goal of invention is to access from all sides which provides more areas (almost 4 times) for consumers and will result in easy, simultaneous and several accesses by different people from any side.

Placement of food materials in high length and suitable depth in one extensive row will result in better access of consumers to food materials in the refrigerator and there will be no need to displace the materials to access to others in the second row. Moreover, food materials will be placed like in a showcase without any need to displacement.

It is possible to place this new model in the middle of the spaces such as kitchen and other places and it is not necessary to necessarily place in the corners and beside the walls; however, due to its rotation capability, it can be placed at any place even beside the walls and on the corners and there will be no restriction in this regard.

Rotation capability of this new model which can be easily done manually or by remote control in terms of rotation around the central axis allows the consumer to rotate it to his intended space, for example kitchen or reception hall, to use his intended part, whether refrigerator or freezer or other side parts, in front of himself without any need to turn around the model.

In any of placement status of the model, whether in the middle of the spaces between reception hall and kitchen as an interface, it will be possible to use the model from both sides in different times and there will be no need for long and unnecessary commuting for use and access to food materials.

Several doors are devised beside each other both for refrigerator and freezer to place food materials. There are also special spaces between the doors intended for ice maker, water cooler, quick freezing system, tea and coffee maker and microwave as well as special spaces with separate doors for storing cakes and pastries, fruits, vegetables and other materials with adjustable temperatures.

BRIEF DESCRIPTION OF THE DRAWINGS

The present invention is illustrated by way of example in the figures of the accompanying drawings, in which like references indicate similar elements and in which:

FIG. 1 illustrates the invention, with doors closed, and showing the underside; many of the central components are depicted.

FIG. 2 illustrates the invention in rear view, with doors open.

FIG. 3 illustrates the invention in front view, with doors open.

FIG. 4 illustrates a cutaway view of the invention, in which the central cooling duct has been removed for improved viewing.

FIG. 5 illustrates an upper view of the invention, including the central cooling duct.

Figure 6:
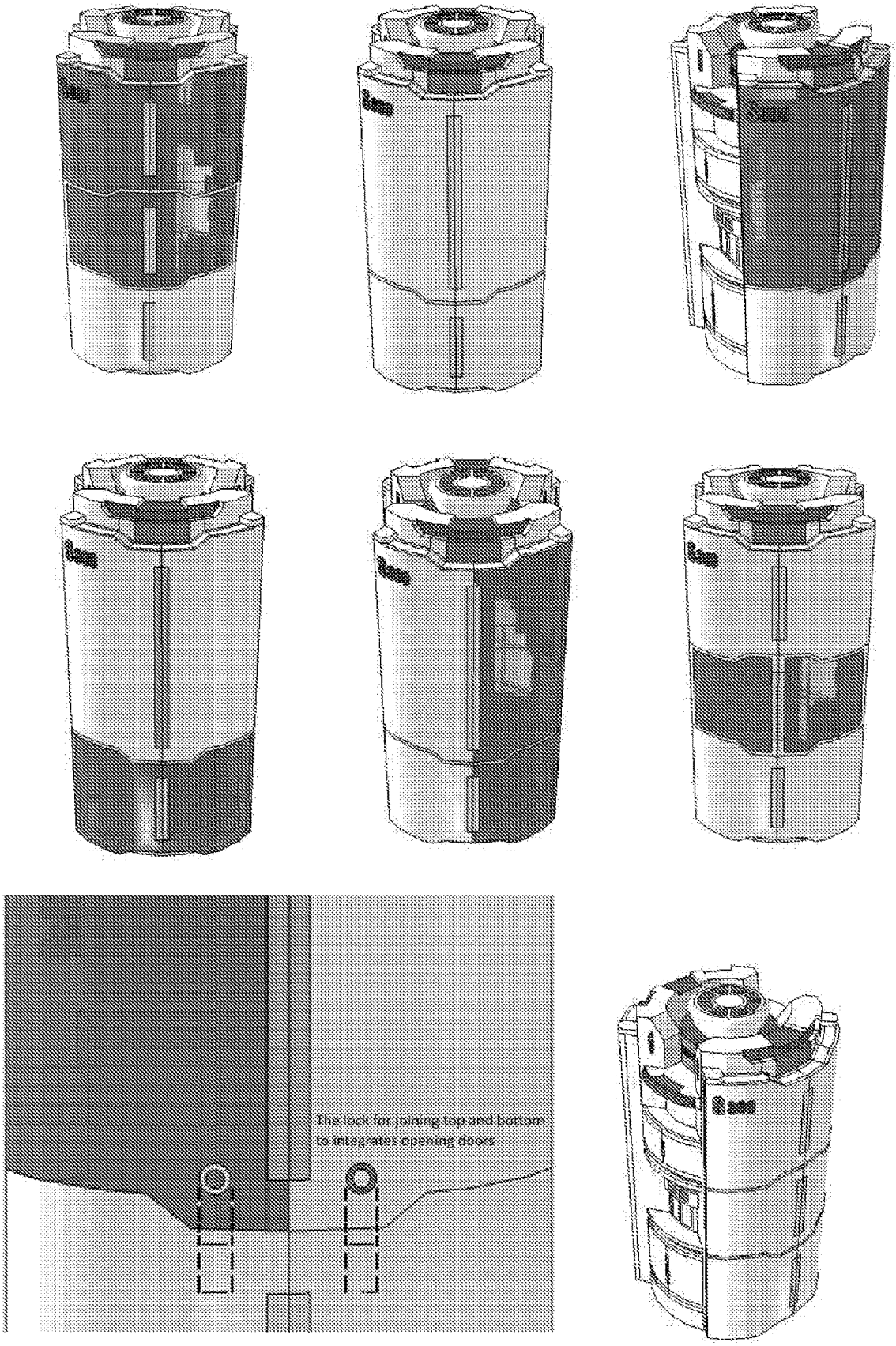
FIG. 6 shows various views of the invention, including cutaway views to shown internal components, views with doors open, and a closeup view of a lock for integrating upper and lower doors.
Figure 7:
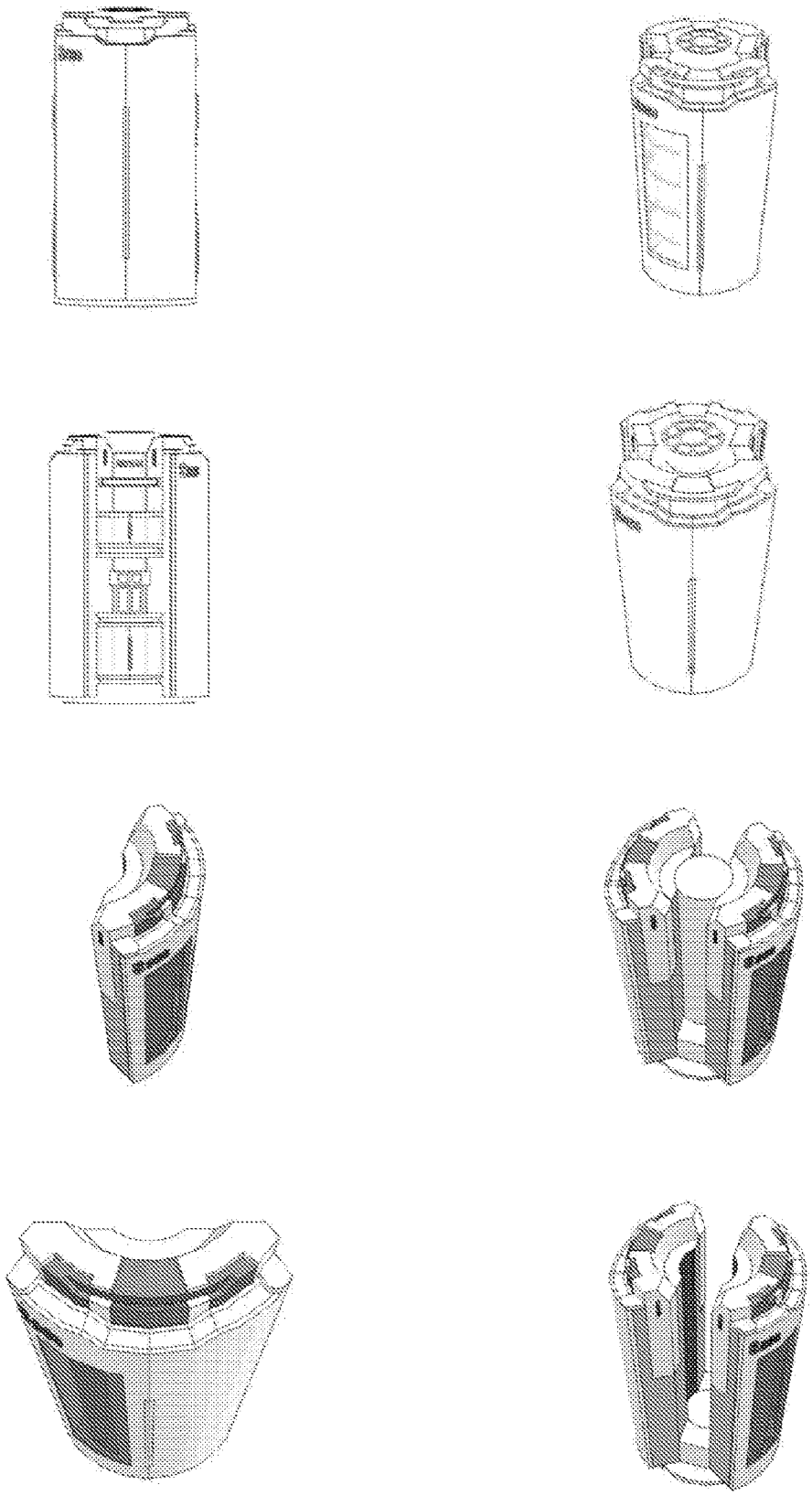
FIG. 7 shows one embodiment of the invention with multiple doors, in various views.
Figure 8:
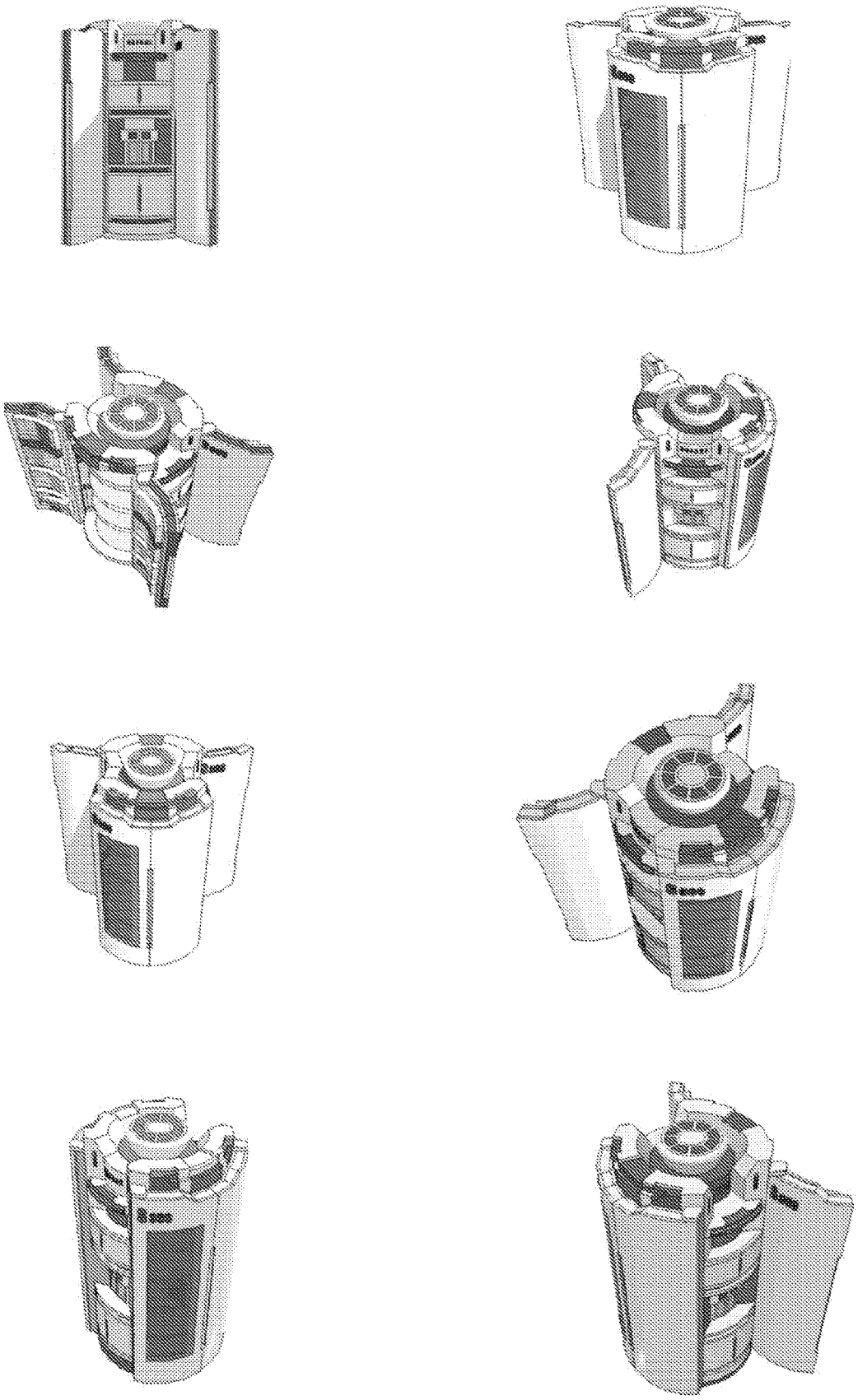
FIG. 8 illustrates various arrangements of the refrigerator and freezer of the invention with several options of placement of the doors.
Figure 9:
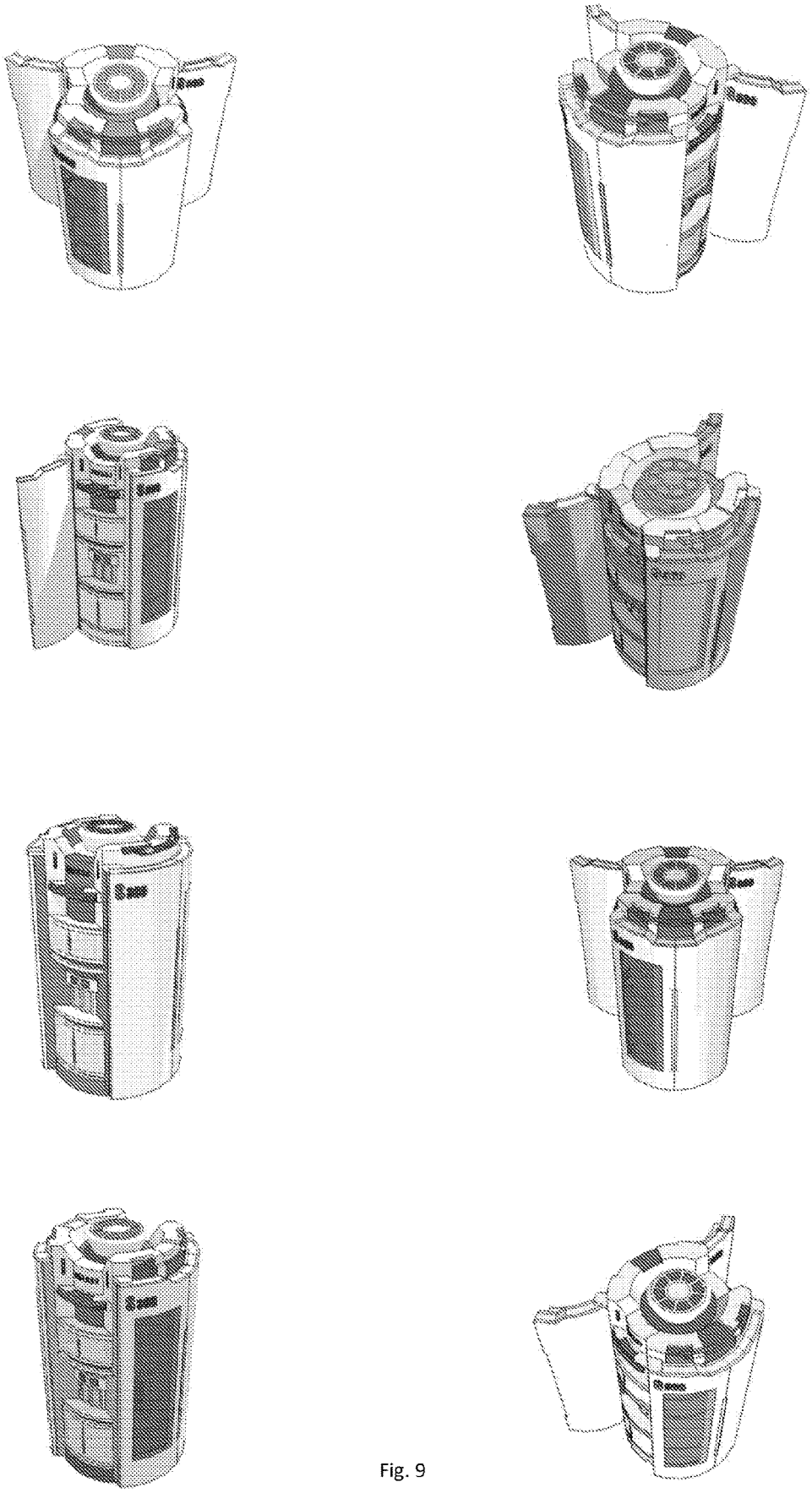
FIG. 9 illustrates additional arrangements of the refrigerator and freezer of the invention with several additional options of placement of the doors.
Figure 10:
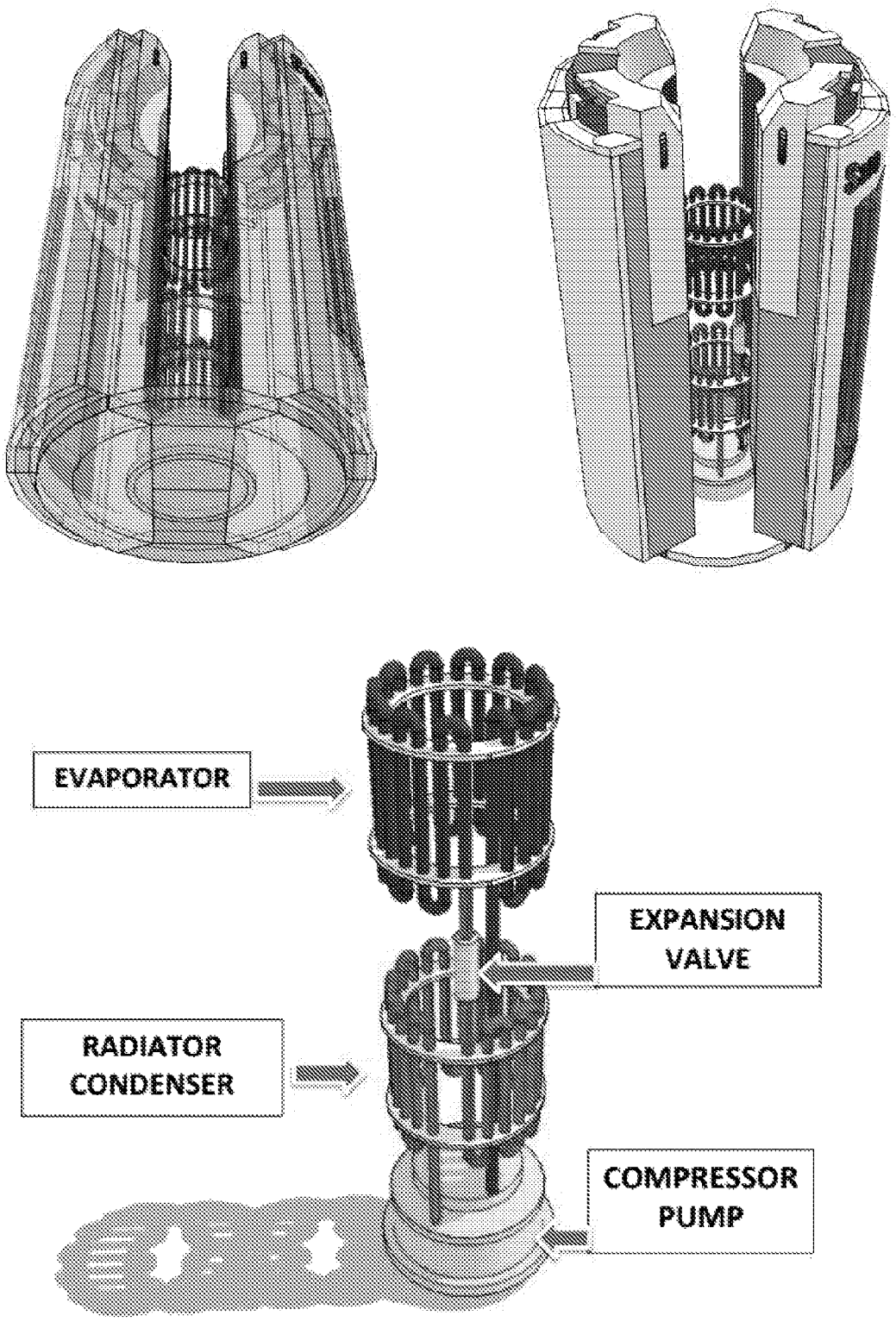
FIG. 10 illustrates internal cooling components.
Figure 11:
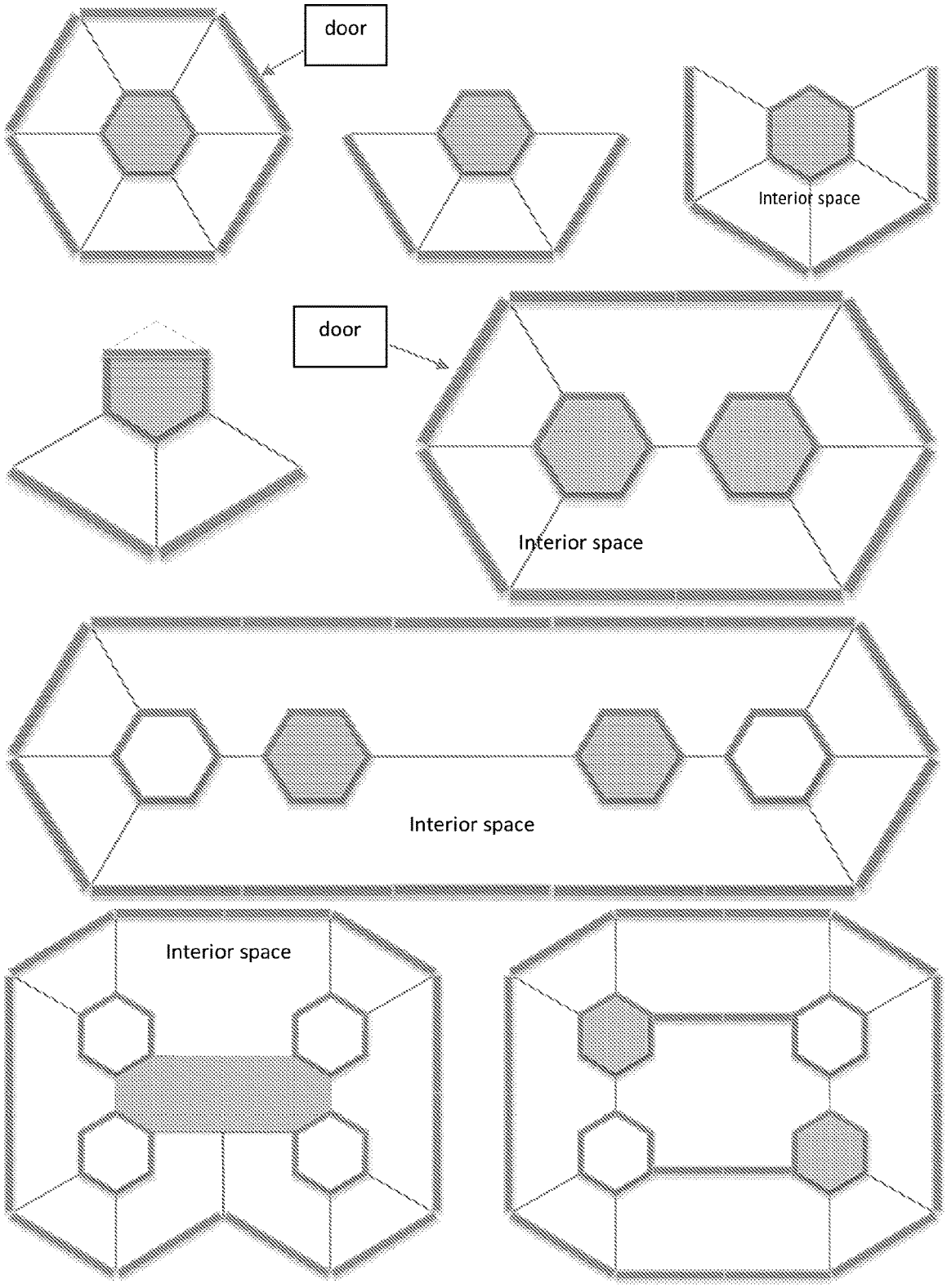
FIG. 11 shows a top view of several embodiments of the invention, illustrating the arrangement of internal space; including a generally cylindrical embodiment, an octagon embodiment, a lengthened octagon embodiment, and an additional complex-shaped designed embodiment.
Figure 12:
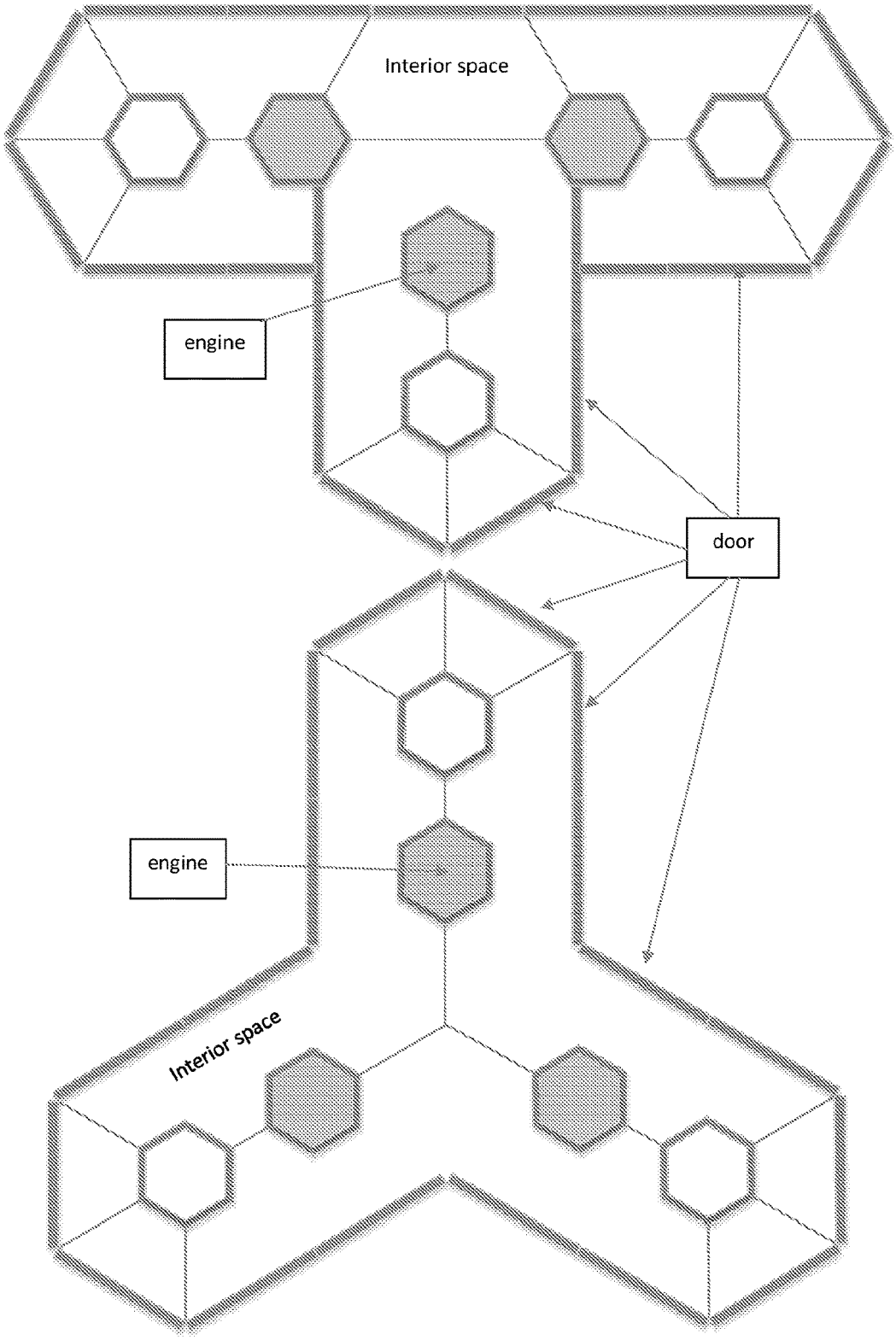
FIG. 12 shows top views of a generally T-shaped embodiment of the invention, and a top view of a three-branched embodiment.
Figure 13:
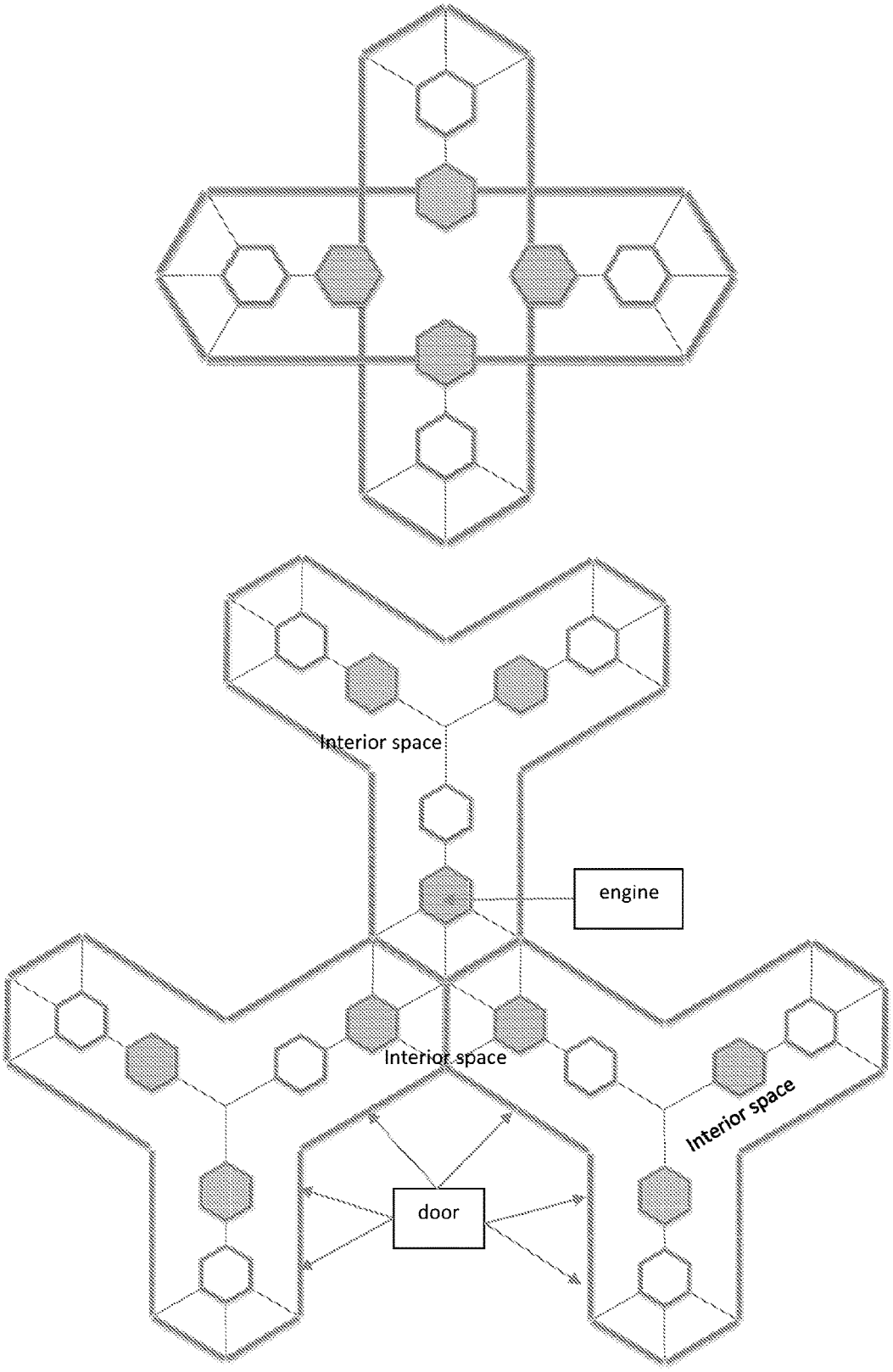
FIG. 13 shows top views of a cross-shaped embodiment, and a complex snowflake shaped embodiment.
Figure 14:
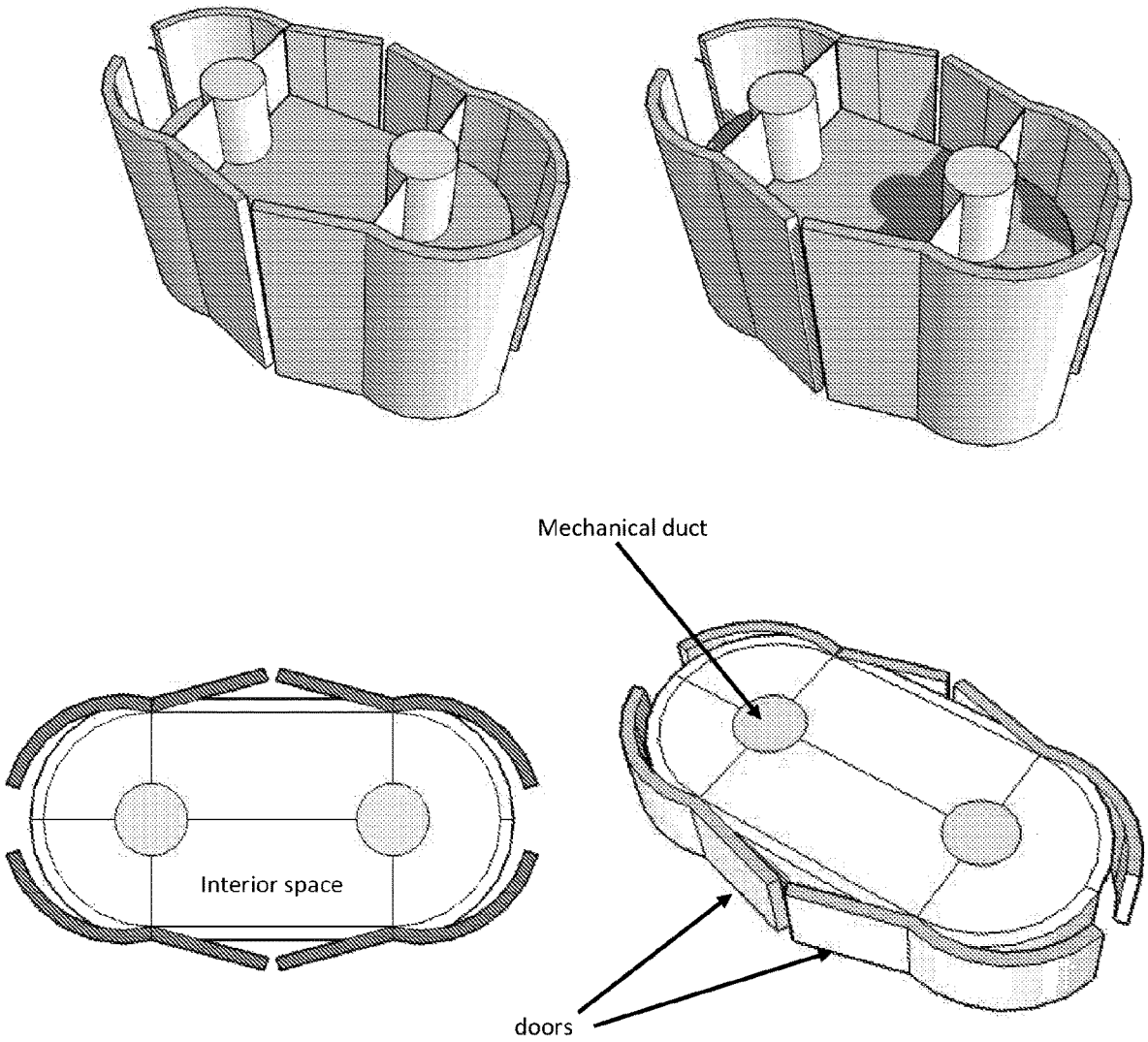
FIG. 14 is a cutaway figure depicting an elliptical embodiment of the invention, showing two central cooling cylinders (mechanical ducts), door arrangements and interior space.

1) Central refrigerator and freezer up to 360° access and view, polygonal and circular, rotary and mobile both manually and electrically by remote control, equipped with water and battery storage reservoir in the upper part of central cylinder, with smart digital system connected to internal and external cameras with the capability to send and receive messages and images to and from owner and/or near stores and connected to the network for smart shopping, with remote control and satellite telephones and the possibility for consumer to access from all sides instead of limited access from one side.

2) The capability to be placed between kitchen and reception halls instead of being placed only on the corners and beside the walls and adjacent cabinets in the kitchens due to removal of restricted one-side use and instead, use of all sides for better and more utilization.

3) The capability of smart adjustment of temperature by processing system and its equalization for integrated use only for refrigerator and/or freezer considering the controllable relation between spaces by smart adjustable trapdoors through central duct and changing and adjusting separate temperatures for more than four main adjacent units including at least two main adjacent spaces in the refrigerator and two main adjacent spaces in the freezer and other lateral spaces with several doors capable of controlling the temperature required for the stored materials in order to save in energy and efficiency based on cooling need of different materials.

4) Transfer of engine and cooling system to the central part (middle vertical duct).

5) Mobile and rotary support of main platform of refrigerator placement in the lower part adjacent to the earth which is the place of establishment of storage batteries and supporter of the main trunk.

6) Increase of access doors of refrigerator and freezer from two side by side doors to more doors considering the increase in peripheral environment accessible from one side to increased access up to 360°.

7) Placement of two adjacent doors as refrigerator and two other adjacent doors as freezer beside each other in different types (side by side refrigerator and side by side freezer).

8) Use of polygonal and circular forms and devising necessary doors in new models up to 360°.

9) Making the trunk of refrigerator and freezer mobile for moving around on the main supporting platform with central main well in the vicinity of earth and rotation around the central axis by the other wheels and ball bearings manually or by remote control.

10) Remote control by telephone system to switch it on and off and to increase and decrease temperature inside refrigerator and freezer and other lateral spaces by a remote control smart electronic board.

11) Internal space of refrigerator is equipped with a camera for sending images to the cell phone of owner through a smart system and/or for connection to the intended stores for information of list and amount of decrease of necessary consuming materials and preparing and sending them to the address where the refrigerator is placed.

12) The model is equipped with a chargeable battery and an upper devised water storage reservoir for use in certain time for the purpose of independency of refrigerator from network water and electricity in urgent times and during long term displacements in the related environment where it is used.

13) Manufacturing the trunk and doors in separate and different pieces capable of being assembled for easy transportation and decrease of weight from one unit to several smaller units.

14) Electricity and water connection through the main support in the lower part of refrigerator when it is in a fixed place.

15) Monitors on both sides adjacent to doors and on the doors in the upper part for displaying the condition and alarms of central smart system of refrigerator and also for displaying satellite channels; e.g., cooking training, etc. where necessary.

16) The model is equipped with processing systems and battery feeding separated in each section and its placement on the four corners above the hinges of the doors in the main trunk.

17) The refrigerator can be used in all angles up to 360°. It can also be placed in angles less than 360°, for example in the corners of halls and kitchen with angles more or less than 90°.

18) Small doors of beside the main doors and also shelves are sliding and becoming up and down manually or automatically with remote control 19) The special lock for joining top and bottom to integrates opening doors 20) All items and forms shown in the attached images.

What is claimed is:

1. A refrigerator and freezer, capable of providing up to 360 degree access to items stored within, comprising:

a mobile main support platform located at a lower end of said refrigerator and freezer, for supporting said refrigerator and freezer; wherein said mobile main support is rotatable about a fixed axis;

an interior space having shelves for holding items to be cooled; said interior space enclosed by at least one hinged freezer door and at least one hinged refrigerator door;

a central cooling cylinder, wherein the central cooling cylinder is associated with and in fluid flow with a water reservoir, an evaporator, a condenser and a compression pump for cooling items placed within said interior space of said refrigerator and freezer;

a battery storage reservoir;

wherein said refrigerator and freezer are essentially polygonal and cylindrical;

and wherein said mobile main platform may be rotated manually, or electrically using a remote control; wherein rotation of said mobile main support platform upon said fixed axis rotates said refrigerator and freezer, to grant 360° user access to said doors;

and a smart digital system connected to a plurality of cameras; wherein a first set of said cameras is situated inside said refrigerator and freezer, and a second set of cameras is situated outside said refrigerator and freezer, and wherein said cameras are capable of transmitting images to one or more users and receiving messages from one or more users;

wherein said smart digital system is connected to a network for smart shopping, wherein a remote control device and a plurality of one or more satellite telephones are also part of the network.

2. The refrigerator and freezer as claimed in claim 1, wherein said hinged freezer and refrigerator doors are comprised of a first pair of adjacent doors for the refrigerator and a second pair of adjacent doors for the freezer, wherein the first pair of adjacent doors and the second pair of adjacent doors for freezer are side-by-side.

3. The refrigerator and freezer as claimed in claim 1, wherein said mobile main support platform is rotatable upon wheels and ball bearings.

4. The refrigerator and freezer as claimed in claim 1, further comprising a remote control set to control the refrigerator and freezer by turning them on or off, adjusting the temperature, and rotating the refrigerator and freezer; wherein the remote control device may be activated using at least one of; the internet, a cellular network, and a telephone remote control system.

5. The refrigerator and freezer as claimed in claim 1, wherein the refrigerator and freezer is equipped with a chargeable battery and an upper devised water storage reservoir for use in certain time for the purpose of independency of refrigerator from network water and electricity in urgent times and during long term displacements in the related environment where it is used.

6. The refrigerator and freezer as claimed in claim 1, wherein said doors are manufactured separately, and are capable of being removed for easy transportation and decrease of weight.

7. The refrigerator and freezer as claimed in claim 2, wherein the refrigerator and freezer includes one of more display devices and one or more speakers on both sides of the first pair of doors and second pair of doors, wherein the one or more display devices display the condition of and alarms pertaining to the refrigerator and freezer, wherein the one or more display devices further display TV, multimedia, and satellite channels.

8. The refrigerator and freezer as claimed in claim 2, wherein a battery is kept in 4 different spaces above the first pair of doors and the second pair of doors, in the central cooling cylinder.

9. The refrigerator and freezer as claimed in claim 2, wherein a plurality of small doors are placed beside the first pair of doors and second pair of doors.

10. The refrigerator and freezer as claimed in claim 1, wherein the central refrigerator and freezer has a lock for joining top and bottom portions of said doors.

11. The refrigerator and freezer as claimed in claim 1, comprising a central computer system capable of sending and receiving messages from the fridge to the manufacturer, to a user, and to a store, using telecommunication systems; and said central computer system is programmed to allow activation of remote diagnostics, troubleshooting, and firmware updates by the manufacturer.

12. The refrigerator and freezer as claimed in claim 1, wherein the refrigerator and freezer has an artificial intelligence assistant system with speech and image recognition for user interfacing.

13. The refrigerator and freezer as claimed in claim 1, wherein the central refrigerator and freezer has an ice maker, a water cooler, a quick freezing system, a tea and a coffee maker, and a microwave oven in spaces between the doors, as well as spaces with separate doors for storing cakes and pastries, fruits, vegetables and other materials, wherein temperatures are separately adjustable in said spaces.

14. The refrigerator and freezer as claimed in claim 1, wherein the refrigerator and freezer further includes an exhaust fan installed at the top of the central cooling cylinder.

15. The refrigerator and freezer as claimed in claim 1, wherein portable storage devices can be connected to the central refrigerator and freezer.

16. The refrigerator and freezer as claimed in claim 1, further including a plurality of sliding shelves that move up and down, either manually or automatically using said remote control.

* * * * *